US006083893A

United States Patent [19]

Zint et al.

[11] Patent Number: 6,083,893

[45] Date of Patent: Jul. 4, 2000

[54] SHAPED SEMI-SOLID OR SOLID DISHWASHING DETERGENT

[75] Inventors: David Robert Zint, Ft. Thomas, Ky.; Mark Leslie Kacher, Mason, Ohio; Tony Pace; Robert Owens, both of Cincinnati, Ohio

[73] Assignee: The Proctor and Gamble Co., Cincinnati, Ohio

[21] Appl. No.: 08/939,348

[22] Filed: Sep. 29, 1997

Related U.S. Application Data

[63] Continuation of application No. 08/697,114, Aug. 20, 1996, abandoned, which is a continuation of application No. 08/243,666, May 16, 1994, abandoned.

[51] Int. Cl.[7] ..... C11D 17/00

[52] U.S. Cl. ..... 510/221; 510/235; 510/404; 510/438; 510/488; 510/491

[58] Field of Search ..... 510/235, 237, 510/403, 438, 488, 221, 223, 228, 229, 404, 447, 450, 491

[56] References Cited

U.S. PATENT DOCUMENTS

| | | | |
|---|---|---|---|
| 4,133,779 | 1/1979 | Hellyer et al. | 252/547 |
| 4,171,278 | 10/1979 | Andree et al. | 252/102 |
| 4,264,466 | 4/1981 | Carleton et al. | 252/99 |
| 4,316,824 | 2/1982 | Pancheri | 252/551 |
| 4,615,819 | 10/1986 | Leng et al. | 252/110 |
| 4,673,525 | 6/1987 | Small et al. | 252/132 |
| 4,681,704 | 7/1987 | Bernardino et al. | 252/546 |
| 4,692,271 | 9/1987 | Messenger et al. | 252/354 |
| 4,732,696 | 3/1988 | Urfer | 252/174.17 |
| 4,753,754 | 6/1988 | Messenger et al. | 252/354 |
| 4,820,447 | 4/1989 | Medcalf, Jr. et al. | 252/117 |
| 4,851,147 | 7/1989 | Esposito et al. | 510/153 |
| 4,871,467 | 10/1989 | Akred et al. | 252/135 |
| 4,889,644 | 12/1989 | Amberg et al. | 252/174.21 |
| 5,035,826 | 7/1991 | Durbut et al. | 252/121 |
| 5,076,953 | 12/1991 | Jordan et al. | 252/108 |
| 5,167,872 | 12/1992 | Pancheri et al. | 252/544 |
| 5,225,097 | 7/1993 | Kacher et al. | 252/108 |
| 5,225,098 | 7/1993 | Kacher et al. | 252/108 |
| 5,227,086 | 7/1993 | Kacher et al. | 252/108 |
| 5,230,823 | 7/1993 | Ofosu-Asante | 510/236 |
| 5,262,079 | 11/1993 | Kacher et al. | 252/108 |
| 5,312,559 | 5/1994 | Kacher et al. | 252/125 |
| 5,324,445 | 6/1994 | Langley et al. | 252/174.12 |
| 5,340,492 | 8/1994 | Kacher et al. | 252/108 |
| 5,362,413 | 11/1994 | Kaufmann et al. | 252/174.21 |
| 5,376,310 | 12/1994 | Cripe et al. | 510/237 |
| 5,378,409 | 1/1995 | Wise et al. | 510/237 |
| 5,391,315 | 2/1995 | Ashkin | 252/108 |
| 5,469,493 | 11/1995 | Cox et al. | 510/152 |

FOREIGN PATENT DOCUMENTS

| | | | |
|---|---|---|---|
| 0 487 169 A1 | 5/1992 | European Pat. Off. | C11D 1/655 |
| WO92/08777 | 5/1992 | WIPO | C11D 1/06 |
| WO92/09679 | 6/1992 | WIPO | C11D 17/00 |
| WO93/03129 | 2/1993 | WIPO | C11D 1/83 |

*Primary Examiner*—Caroline D. Liott
*Attorney, Agent, or Firm*—Marianne Dressman; Daniel F. Nesbitt; Milton B. Graff

[57] ABSTRACT

The present invention provides a firm, mild, good performing, low-smear semi-solid or solid dishwashing product. The rheology of the dishwashing product is such that structural elements have been separated from functional elements to obtain best structure properties and in-use properties. By using an interlocking mesh of carboxylic acid and/or neutralized carboxylic acid fibers and/or platelets to provide a support structure, the semi-solid or solid dishwashing product can be loaded with superior performing dishcare materials (e.g., mild surfactants) and appearance enhancers without dependence on surfactant-water phase behavior to provide the support structure. As a result, the present dishwashing product is milder than semi-solid dishwashing products currently on the market. The support structure of the present product, and preferably the use of hygroscopic surfactants, provide a product with lower smear than current gel dishwashing products.

19 Claims, No Drawings

SHAPED SEMI-SOLID OR SOLID DISHWASHING DETERGENT

This is a continuation of application Ser. No. 08/697,114, filed on Aug. 20, 1996, abandoned, which was a continuation of application Ser. No. 08/243,666, filed May 16, 1994, abandoned.

TECHNICAL FIELD

The present invention relates to a shaped semi-solid or solid dishwashing product made with a rigid, interlocking mesh of carboxylic acid and/or neutralized carboxylic acid.

BACKGROUND OF THE INVENTION

Conventional semi-solid dishwashing products provide effective cleaning, but they can also present certain disadvantages to the consumer. For example, conventional dishwashing gels depend on a surfactant/water interaction to form their structure, so they are limited in the types and amounts of surfactants and other materials that can be used in the gels. As a result, the gels can experience smear problems upon prolonged contact with water, and the gels may not be as mild to the skin as would be preferred. Therefore, there is currently a need for semi-solid or solid dishwashing products that are mild and have low smear, while still providing good cleaning and sudsing performance.

SUMMARY OF THE INVENTION

The present invention provides a firm, mild, good performing, low-smear semi-solid or solid dishwashing product. The rheology of the dishwashing product is such that structural elements have been separated from functional elements to obtain best structure properties and in-use properties. By using an interlocking mesh of carboxylic acid and/or neutralized carboxylic acid fibers and/or platelets to provide a support structure, the semi-solid or solid dishwashing product can be loaded with superior performing dishcare materials (e.g., mild surfactants) and appearance enhancers without dependence on surfactant-water phase behavior to provide the support structure. As a result, the present dishwashing product is milder than semi-solid dishwashing products currently on the market. The support structure of the present product, and preferably the use of hygroscopic surfactants, provide a product with lower smear than current gel dishwashing products.

DETAILED DESCRIPTION OF THE INVENTION

The invention provides a shaped semi-solid or solid dishwashing product comprising two or more phases. One phase is a crystalline skeleton structure comprising a relatively rigid, interlocking, open, three-dimensional mesh of carboxylic acid and/or neutralized carboxylic acid elongated crystals. (The carboxylic acid can be mono- and/or dicarboxylic acid.) The other essential phase is an aqueous phase which is soft or flowable at 25° C. The product contains surprisingly high levels of said aqueous phase comprising water, other liquids and soft materials. Notwithstanding the presence of relatively large levels of an aqueous phase, the skeleton structure enables the dishwashing products to maintain their form and excellent properties.

The terms: "skeleton structure", "skeletal structure", "core", and "skeleton frame" are used interchangeably herein.

The terms "shaped semi-solid or solid" as used herein includes forms such as creams, pastes and bars. Advantageously, the hardness of the products can be varied to meet consumer needs and preferences. A preferred product according to the present invention is a dishwashing paste which is held in a tub or other container.

The term "mesh" as used herein means an interlocking crystalline skeleton network with voids or openings when viewed under magnification by scanning electron microscopy.

The crystalline phase skeleton structure, comprising the carboxylic acid and/or neutralized carboxylic acid, comprises from about 5% to about 75% by weight of the dishwashing product. This crystalline phase comprises crystals in the form of either interlocking platelets and/or fibers, preferably fibers. Preferably said fibers are composed of sodium soap (i.e., sodium neutralized monocarboxylic acid). The interlocking mesh of said fibers and/or platelets imparts strength to the three-dimensional structure, even in the presence of relatively high levels of water or other soft materials. The strength of the skeleton structure can be measured indirectly by the hardness of the shaped semi-solid or solid product, as determined by the resistance to penetration of the product using a Standard Weighted Penetrometer Probe. (See the "Test Methods" section for more details.) The present dishwashing product preferably has a penetration between 1 and about 10, more preferably between 1 and about 7, and most preferably between 2 and about 4. Preferred products according to the invention are softer than bars.

The skeletal structure contains substantial "void" areas which are filled by soft and/or liquid aqueous phases. It is a surprising aspect of this invention that the physical properties of the shaped semi-solid or solid product, such as product hardness and little smear, are mostly dependent on the crystalline interlocking mesh structure, even when the other phases make up a majority of the materials present.

The present dishwashing product is preferred when the neutralized carboxylic acid is selected from the group consisting of lithium and/or sodium neutralized monocarboxylic acid (soap) and/or dicarboxylic acid, and mixtures thereof; wherein said monocarboxylic acid has a fatty alkyl(ene) chain of from about 12 to about 24 carbon atoms; wherein said dicarboxylic acid has a fatty alkyl(ene) chain of from about 12 to about 18 carbon atoms; wherein said carboxylic acid has not more than about 50% total unsaturated alkyl (ene) chains and/or short chain length (<10 carbons) alkyl (ene) chains; wherein said carboxylic acid has at least about 80% saturated alkyl(ene) chains; wherein said rigid crystalline phase skeleton structure occupies from about 3% to about 75% of the dishwashing product by volume; and wherein said dishwashing product contains from about 15% to about 94% water by weight of said dishwashing product. Preferred products contain less than about 5% short chain length (<10) alkyl(ene) chains.

The present dishwashing product is preferred when at least 80%, preferably at least 90%, of the carboxylic acid has the following general formula:

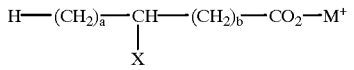

wherein:
a + b = 8 to 20
each a, b = 0 to 20

X = H, OR, O—C(=O)—R, R, or mixtures thereof
R = $C_1$—$C_3$ alkyl, H, or mixtures thereof
M = Na, Li, or mixtures thereof.

The present dishwashing product is more preferred when said a+b=10–16; each of said a, b=0–16; said X=H, OR; R=H; and M=Na.

The present dishwashing product is preferred when said elongated crystals are composed of fiber-like sodium fatty acid soap (i.e., sodium neutralized monocarboxylic acid) of which at least about 25% of said saturated fatty alkyl chains are of a single chain length; wherein said product contains from about 6% to about 50% of said sodium soap; wherein the ratio of unneutralized (free) carboxylic acid to soap is from about 1:1 to about 0; and wherein the ratio of water to soap is from about 0.3:1 to about 16:1.

The above dishwashing product is preferred when the ratio of said water to said soap is from about 0.7:1 to about 7.5:1; said water is present at a level of from about 25% to about 60%; wherein said fatty alkyl chains are $C_{14}$ to $C_{22}$ and said soap level in said product is from about 7% to about 35%; wherein at least about 85% of said alkyl chains are saturated; wherein the ratio of unneutralized (free) carboxylic acid to soap is from about 1:3 to 0; and wherein said synthetic surfactant level is from about 4% to about 30% by weight of the product.

The above dishwashing product is more preferred when the ratio of said water to said soap is from about 1:1 to about 4.5:1; wherein the ratio of unneutralized (free) carboxylic acid to soap is from about 1:6 to 0; said water level is from about 30% to about 45%; said fatty alkyl chain length is from about $C_{14}$ to about $C_{18}$; wherein at least about 95% of said alkyl chains are saturated; said soap level is from about 7% to about 25%; and said synthetic surfactant level is from about 8% to about 25%.

It has been found that good dishwashing detergents according to the present invention can be made with surprisingly low levels of carboxylic acid and/or neutralized carboxylic acid, between about 7% and about 30% by weight, and even not more than about 25% by weight, or not more than about 15% by weight.

The above dishwashing product is preferred when said product contains sodium soap, water, and synthetic surfactant, and from about 0.1% to about 70% of other ingredients selected from the group consisting of:

from about 1% to about 10% said potassium soap;

from about 1% to about 35% said magnesium soap;

from about 1% to about 35% said calcium soap;

from about 1% to about 15% triethanolammonium soap; and from about 1% to about 50% of salt and salt hydrates.

The sodium soap is preferably at least about 50% of the soap present in the dishwashing product. The levels of potassium soap and/or triethanolammonium soap should not exceed one-half, preferably one-third, more preferably less than one-fourth, that of the sodium soap and the level of magnesium soap should not exceed about one-third of the level of sodium soap, and is preferably less than about one-fourth that of the sodium soap. The total of other soaps, such as lithium soap, should preferably not exceed one-half, preferably one-third, of the sodium soap.

The dishwashing product of the present invention contains from about 2% to about 60% synthetic surfactant by weight of the product, preferably from about 4% to about 30%, and more preferably from about 8% to about 25%. As discussed above, the surfactants can be selected for their mildness and performance properties because they are not depended on to provide the support structure of the product. Preferred surfactants are selected from amine oxides, polyhydroxy fatty acid amides, ethoxylated alkyl sulfates, alkyl ethoxylates, and mixtures thereof. Other commonly used surfactants include alkyl sulfates, alkylbenzene sulfonates, alkyl ether carboxylates, alkyl glycosides, methyl glucose esters, betaines, and mixtures thereof.

Hygroscopic surfactants are preferred because they tend to keep the dishwashing product from becoming soft as water lies on its surface, so that there is low smear. A "hygroscopic surfactant" herein is defined as a surfactant which absorbs at least 20% of its dry weight in water at 26° C. and 80% Relative Humidity in three days. The hygroscopic surfactant is preferably selected from the group consisting of alpha sulfo fatty acid esters; alkyl sulfates; alkyl ether carboxylates; alkyl betaines; alkyl sultaines; alkyl amine oxides; alkyl ether sulfates; and mixtures thereof.

Amine oxide semi-polar nonionic surfactants comprise compounds and mixtures of compounds having the formula:

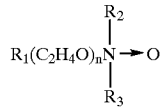

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10.

Particularly preferred are amine oxides of the formula:

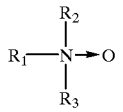

wherein $R_1$ is a $C_{10-18}$ alkyl and $R_2$ and $R_3$ are methyl. The above amine oxides are more fully described in U.S. Pat. No. 4,316,824 to Pancheri, which is incorporated herein by reference. The Procter & Gamble Company, Cincinnati, Ohio, also manufactures suitable amine oxides such as $C_{1-16}$ (predominantly $C_{12}$) alkyl dimethyl amine oxides. The $C_{12}$, $C_{14}$, $C_{16}$, $C_{14-16}$, and $C_{16-18}$ alkyl dimethyl amine oxides are available commercially from Stepan Chemical Company under the tradename Ammonyx.

The polyhydroxy fatty acid amide surfactant comprises compounds of the structural formula:

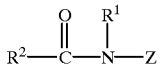

wherein $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ alkyl (i.e., methyl); and $R^2$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{16}$ alkyl or alkenyl, or mixture thereof; and Z is a polyhydroxyhydrocarbyl moiety having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, and $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$. $R^1$ can be, for example, N-methyl, N-ethyl, N-propyl, N-isopropyl, N-butyl, N-2-hydroxy ethyl, or N-2-hydroxy propyl. $R^2—CO—N<$ can be, for example, cocamide, stearamide, oleamide, lauramide, myrstamide, capricamide, palmitamide or tallowamide. Z can be, for example, 1-deoxyglucityl, 2-deoxyfructityl, 1-deoxymaltityl, 1-deoxylactityl, 1-deoxygalactityl, 1-deoxymannityl or 1-deoxymaltotnotityl. A preferred polyhydroxy fatty acid amide is N-cocoyl N-methyl glucamide.

The suitable ethoxylated alkyl sulfate surfactants are derived from ethoxylating an alcohol having from about 8 to about 22 carbon atoms, preferably from about 12 to about 16 carbon atoms, with from about 1 to about 30 moles of ethylene oxide, preferably from about 1 to about 12 moles of ethylene oxide and then sulfating. The ethoxylated alkyl sulfates have the formula $[RO(C_2H_4O)_xSO_3]_iM^{+i}$ where R is the $C_{8-22}$ alkyl group, x is 1–30, M is a counter-ion such as sodium, potassium, ammonium, alkanolammonium and magnesium (preferably sodium or magnesium), and i is either 1 or 2 depending on whether the counter-ion is mono- or divalent. Preferred ethoxylated alkyl sulfate surfactants according to the present invention include those where the alkyl group is derived from coconut or palm base, such as mid-cut coconut ($C_{12-14}$) or broad-cut coconut ($C_{12-18}$). Surfactants of this type are available commercially from Akzo Chemicals, 516 Duren, Germany, under the tradenames ELFAN NS 243 S conc. and NS 242 S conc. ($Na^+$ cation, alkyl group having an average chain length of $C_{12-14}$, average degree of ethoxylation of 3 and 2 respectively), and ELFAN NS 243 Mg conc. (same as above, but with $Mg^{++}$ cation). Preferred ethoxylated alkyl sulfates of this type are also available commercially from Hoechst Corp. Venezuela, and Taiwan NJC Corp., No. 45, Chung-Cheng Rd., Ming-Hsiung Industrial Park, Ming Hsuing, Chia-Yi Hsien, Taiwan, R.O.C. (Na $AE_2S$ and Na $AE_3S$, where the alkyl group is $C_{12-14}$). Synthetic surfactants (derived from synthetic alcohols) such as those containing $C_{12-13}$ or $C_{12-15}$ alkyl groups are also preferred. Such synthetic surfactants are commercially available from South Pearl Corp., Puerto Rico, U.S.A. and other companies. Specific examples of preferred surfactants are Na $C_{12-14}AE_2S$, Na $C_{12-15}AE_3S$, Na $C_{12-13}AE_1S$, and their counterparts containing magnesium cations and/or having other degrees of ethoxylation. Other suitable surfactants include, but are not limited to, ethoxylated alkyl sulfates surfactants where the alkyl group is lauryl ($C_{12}$) or myristyl ($C_{14}$).

The alkyl sulfates useful herein are those obtained by sulfating an alcohol having from about 8 to about 22 carbon atoms, preferably from about 12 to about 16 carbon atoms. The alkyl sulfates have the formula $[ROSO_3^-]_iM^{+i}$ where R is the $C_{8-22}$ alkyl group, M is a counter-ion such as sodium, potassium, ammonium, alkanolammonium and magnesium (preferably sodium or magnesium), and i is either 1 or 2 depending on whether the counter-ion is mono- or divalent. Specific examples of suitable alkyl sulfates include lauryl sulfates, stearyl sulfates, palmityl sulfates, decyl sulfates, myristyl sulfates, tallow alkyl sulfates, coconut alkyl sulfates, $C_{12-15}$ alkyl sulfates and mixtures of these surfactants (with the above-mentioned counter-ions).

Suitable alkylbenzene sulfonates include the alkali metal (lithium, sodium, and/or potassium, preferably sodium), alkaline earth (preferably magnesium), ammonium and/or alkanolammonium salts of straight or branched chain alkylbenzene sulfonic acids in which the alkyl group contains from about 9 to about 15 carbon atoms. Preferred alkylbenzene sulfonates are those in which the alkyl chain is linear and averages about 11 to about 13 carbon atoms in length, most preferably from about 11.3 to about 12.3 carbon atoms in length. Examples of commercially available alkylbenzene sulfonates useful in the present invention include Conoco SA 515 and SA 597 marketed by the Continental Oil Company and Calsoft LAS 99 marketed by the Pilot Chemical Company.

Alkyl ethoxy carboxylates have the general formula $$RO(CH_2CH_2O)_kCH_2COO^-M^+$$

wherein R is a $C_{8-22}$ alkyl group, k is an integer ranging from 0 to 10, and M is a cation (preferably sodium).

Betaines are surfactants having the general formula:

$$R—\overset{(+)}{N}(R^1)_2—\overset{(-)}{R^2COO}$$

wherein R is a hydrophobic group selected from the group consisting of alkyl groups containing from about 10 to about 22 carbon atoms, preferably from about 12 to 18 carbon atoms; alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms. Examples of preferred betaines are cetyl dimethyl betaine, dodecyl dimethyl betaine, coco amido propyl betaine, dodecyl amidopropyldimethyl betaine, and dodecyldimethylammonium hexanoate.

The alpha-sulfonated fatty acid alkyl ester surfactant has the general formula

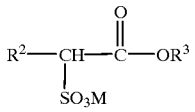

wherein $R^2$ is alkyl having from 8 to 20 carbon atoms; $R^3$ is alkyl having from 1 to 4 carbon atoms; and M is selected from the group consisting of Na, K, Li and $NH_4$, and mixtures thereof. Preferred is an ester salt wherein $R^2$ is $C_{16}$–$C_{18}$ alkyl, $R^3$ is methyl, and M is Na.

Other synthetic surfactants known to those skilled in the art can also be used in the present invention. The other surfactants can be nonionic, anionic, cationic, zwitterionic, ampholitic or amphoteric.

The pH of a 1% solution of the present dishwashing detergent in water is from about 5 to about 12, preferably from about 8.0 to about 10.2, and most preferably, from about 8.0 to about 8.5. The present dishwashing product preferably uses predominantly neutralized carboxylic acid (so higher pH) to enable the dishcare surfactants to perform their best in sudsing and grease cutting.

The dishwashing product of the invention can contain, if desired, any of the usual adjuvants, diluents and additives known to those skilled in the art for use in dishwashing detergents, for example, bleaching agents, perfumes, enzymes, amino acids, dyes, antitarnishing agents, antimicrobial agents, suds enhancers, and the like, without detracting from the advantageous properties of the compositions.

Tables 1–3 set out some preferred dishwashing products according to the present invention. The percentages, ratios and parts herein are on a total composition weight basis, unless otherwise specified.

TABLE 1

Preferred Dishwashing Products, Chain Lengths and Levels

| | Preferred | More Preferred | Most Preferred |
|---|---|---|---|
| Water Level | 15–94% | 25–60% | 30–45% |
| Water:Soap Ratio | 0.3:1–16:1 | 0.7:1–7.5:1 | 1:1–4.5:1 |
| FA Chain Length | $C_{12}$–$C_{24}$ | $C_{14-22}$ | $C_{14-18}$ |
| Soap Level in Total Formulation | 6–50% | 7–35% | 7–25% |

All highs and lows are not necessarily shown in Table 1. For example, some selected sodium soap can be used at a level up to about 75%. Thus, the range is from about 5% to about 75%. The preferred levels and ratios can vary from cation to cation, etc., and from mono- to dicarboxylic acids.

Table 2 below shows some preferred levels of soaps of a single FA chain length. Table 3 shows some preferred levels of unsaturation in the FA's used in the compositions of the present invention.

TABLE 2

The % Soap of Single Chain Length (of Total Soap Content)

| | Preferred | More Preferred | Most Preferred |
|---|---|---|---|
| $C_{12-24}$ | 25–100% | 50–100% | 75–100% |

TABLE 3

The Total % Unsaturated Chain Length Soaps

| | Broad | Preferred | More Preferred |
|---|---|---|---|
| $C_{12}$ | 0–15% | 0–5% | 0–1% |
| $C_{14-24}$ | 0–50% | 0–10% | 0–1% |

The shaped semi-solid or solid dishwashing products of the invention preferably , contain appearance aids, to retain water, prevent shrinkage, or otherwise improve appearance. Appearance aids are preferably selected from the group consisting of:

compatible salt and salt hydrates;

water-soluble nonionic organics such as polyols, urea;

aluminosilicates and clays; and mixtures thereof. Since these materials are optional, the subject invention also includes compositions not containing compatible salt or salt hydrates, and/or water-soluble nonionic organics such as polyols or urea, and/or aluminosilicates or clays.

Compatible salt and salt hydrates are used to stabilize the dishwashing product appearance via the retention of water. Preferably the dishwashing products contain from about 1% to about 50% of such materials, and more preferably from about 1% to about 15%. Some preferred salts are sodium chloride, sodium sulfate, disodium hydrogen phosphate, sodium pyrophosphate, sodium tetraborate. Generally, compatible salts and salt hydrates include the sodium, potassium, magnesium, calcium, aluminum, lithium, and ammonium salts of inorganic acids and small (6 carbons or less) carboxylic or other organic acids, corresponding hydrates, and mixtures thereof, are applicable. The inorganic salts include chloride, bromide, sulfate, metasilicate, orthophosphate, pyrophosphate, polyphosphate, metaborate, tetraborate, and carbonate. The organic salts include acetate, formate, methyl sulfate, and citrate. Water-soluble amine salts can also be used. Monoethanolamine, diethanolamine, and triethanolammonium (TEA) chloride salts are preferred.

Water-soluble nonionic organics are also used to stabilize the appearance of the dishwashing products of the present invention. Preferably the dishwashing products contain from about 1% to about 50% of these materials, more preferably from about 2% to about 40%, and most preferably from about 5% to about 20%. Some preferred water-soluble nonionic organics are propylene glycol, glycerine, ethylene glycol, sucrose, and urea, and other compatible polyols. Glycerine and glycol can be used to make an opaque product more transparent. Other compatible organics include polyols, such as ethylene glycol or 1,7-heptane-diol, respectively the mono- and polyethylene and propylene glycols of up to about 8,000 molecular weight, any mono-$C_{1-14}$ alkyl ethers thereof, sorbitol, glycerol, glucose, diglycerol, sucrose, lactose, dextrose, 2-pentanol, 1-butanol, mono- di- and triethanolammonium, 2-amino-1-butanol, and the like, especially the polyhydric alcohols.

The aluminosilicates and/or clays are preferably used at levels between about 0.5% and about 25% by weight of the dishwashing product, more preferably between about 1% and about 10%, and most preferably between about 3% and about 8%.

A preferred process of making the dishwashing product of the present invention comprises the steps of:

I. forming an aqueous molten liquid comprising about 15% to about 94% water and from about 5% to about 75% by weight said neutralized carboxylic acid;

II. pouring said molten liquid into a mold to shape the product; and

III. crystallizing said molded molten liquid by cooling to provide said semi-solid or solid dishwashing product.

The above process is preferred when the aqueous molten liquid is made by neutralizing an aqueous mixture of said carboxylic acid with sodium hydroxide or lithium hydroxide with stirring at a temperature of from about 50° C. (120° F.) to about 95° C. (205° F.).

Test Methods

Product Hardness Test

The hardness of the semi-solid or solid product is determined by measuring at 25° C. the depth of penetration (in mm) into the product of a 235 gram Standard Weighted Penetrometer Probe. A 15 mm deep product sample is used. The Probe consists of a 22.9 cm (9 inch) shaft having a round ball (diameter of 1.27 cm (½ inch) at the bottom (the shaft and ball together weighing 35 grams) with 200 grams on top of the shaft. A hardness measurement of 4 mm or less indicates a firm or hard product; 48 mm indicates a somewhat soft product; 8–12 mm indicates a soft product; and greater than 12 mm indicates a very soft product.

Product Smear Test

The smear grade is determined by (1) placing a sample of the product on a perch in a 1400 mm diameter circular dish; (2) adding 200 ml of room temperature water to the dish such that the bottom 3 mm of the product sample is submerged in water; (3) letting the product sample soak overnight (15 hours); (4) turn the product sample over and grade qualitatively for the combined amount of smear, and characteristics of smear, depth of smear on a scale where 10 equals no smear, 8.0–9.5 equals low smear, 5.0–7.5 equals moderate smear, and 4.5 or less equals very poor smear. (Typical commercial dishwashing gels have very poor smear.)

EXAMPLES

Shaped semi-solid and solid dishwashing detergents according to the present invention are formulated as follows:

| | 1 | 2 | 3 | 4 | 5 |
|---|---|---|---|---|---|
| Lauric Acid | 10 | 10 | — | 30 | — |
| Stearic Acid | — | — | 10 | — | — |
| 12 Hydroxy Stearic Acid | — | — | — | — | 7 |
| NaOH | 2.0 | 2.0 | 1.42 | 5.97 | 1.0 |
| NaCl | 2.0 | 2.0 | — | 2.0 | 1.0 |
| $Ca^{++}$ (as formate) | 0.27 | — | — | — | — |
| $Mg^{++}$(as $Cl_2$) | 0.77 | 0.63 | 0.63 | 0.63 | — |
| $Mg^{++}$(as $SO_4$) | — | — | — | — | 0.63 |
| $Mg(AE_3S)_2$ | 19.21 | 16.0 | 16.0 | 12.0 | 0.0 |
| $NaAE_{2.2}S$ | — | — | — | — | 12.0 |
| Amine Oxide | 3.0 | 14.0 | 14.0 | 14.0 | 14.0 |
| $C11E_9$ | 2.1 | 5.0 | 5.0 | — | — |
| Polyhydroxy Fatty Acid Amide | 6.0 | — | — | — | — |
| Blue Dye (.1%) | 0.2 | 0.2 | 0.2 | 0.2 | 0.2 |
| Green Dye (2%) | 0.26 | 0.26 | 0.26 | 0.26 | 0.26 |
| Perfume, FS. | 0.50 | 0.50 | 0.50 | 0.50 | 0.50 |
| Ethanol | 1.59 | 2.58 | — | — | — |
| pH | 8.2 | 10.2 | 8.6 | 9.0 | 9.2 |
| Cap Test Index | — | 105 | 104 | 94 | 83 |
| Suds Index | — | 227 | 293 | 219 | — |
| Product Hardness (Penetrometer) | — | — | 4 mm | 1 mm | 1 mm |

The dishwashing products are mild and have low smear. The "Cap Test Index" and "Suds Index" indicate that the products have good grease cutting ability and good sudsing.

We claim:

1. A shaped, semi-solid dishwashing detergent composition comprising two phases:

(1) an aqueous phase which is soft or flowable at 25° C.; and (2) a rigid crystalline phase skeleton structure comprising an interlocking, open three-dimensional mesh of elongated crystals of unneutralized carboxylic acids, neutralized carboxylic acids, or a mixture thereof; the carboxylic acids being selected from the group consisting of monocarboxylic acids with alkyl(ene) chains having an average of from about 12 to about 24 carbon atoms, dicarboxylic acids with alkyl(ene) chains having an average of from about 12 to about 18 carbon atoms, and mixtures thereof;

wherein the composition comprises:

(a) from about 7% to about 15% by weight crystalline phase skeleton structure (2);

(b) from about 25% to about 94% by weight water; and (c) from about 2% to 35% by weight synthetic surfactant, the synthetic surfactant being selected from the group consisting of amine oxides, polyhydroxy fatty acid amides, ethoxylated alkyl sulfates, alkyl ethoxylates, alkyl sulfates, alkyl benzene sulfonates, alkyl ether carboxylates, alkyl glycosides, methyl glucose esters, betaines, and mixtures thereof;

the composition not containing polyol; the composition being a shaped semi-solid, having a penetration of from 1 mm to about 10 mm, the penetration being measured at 25° C., using a 235 gram Standard Weighted Penetrometer Probe having a 1.27 cm diameter ball attached to a shaft with 200 grams on top of the shaft.

2. The composition of claim 1 wherein the composition comprises from about 25% to about 60% water, and from about 4% to 35% synthetic surfactant selected from the group consisting of amine oxides, polyhydroxy fatty acid amides, ethoxylated alkyl sulfates, alkyl ethoxylates, and mixtures thereof.

3. The composition of claim 2 wherein the crystalline phase skeleton structure (2) comprises neutralized monocarboxylic acids or a mixture of unneutralized monocarboxylic acids and neutralized monocarboxylic acids; the composition comprises from about 7% to about 15% neutralized monocarboxylic acids; the composition has a ratio of unneutralized monocarboxylic acids to neutralized monocarboxylic acids of from about 1:1 to about 0:1; and the composition has a ratio of water to neutralized monocarboxylic acids of from about 0.3:1 to about 16:1.

4. The composition of claim 3 wherein the composition comprises:

(a) from about 7% to about 15% neutralized monocarboxylic acids, at least about 85% of the alkyl(ene) chains of the monocarboxylic acids being saturated, and the ratio of unneutralized monocarboxylic acids to neutralized monocarboxylic acids being from about 1:3 to about 0:1;

(b) from about 25% to about 60% water, the ratio of water to neutralized monocarboxylic acids being from about 0.7:1 to about 7.5:1; and (c) from about 8% to about 30% synthetic surfactant.

5. The composition of claim 3 wherein the composition comprises:

(a) from about 7% to about 15% neutralized monocarboxylic acids, the ratio of unnewutralized monocarboxylic acids to neutralized monocarboxylic acids being from about 1:6 to about 0:1, the average chain length of the unneutralized and neutralized monocarboxylic acids being from about C14 to about C18, and at least about 95% of the alkyl(ene) chains of the monocarboxylic acids being saturated;

(b) from about 30% to about 45% water, the ratio of water to neutralized monocarboxylic acids being from about 1:1 to about 4.5:1; and (c) from about 8% to about 30% synthetic surfactant.

6. The composition of claim 1, 3 or 5 wherein the cation of the neutralized carboxylic acid is sodium or lithium.

7. A shaped, semi-solid dishwashing detergent composition comprising two phases:

(1) an aqueous phase which is soft or flowable at 25° C.; and (2) a rigid crystalline phase skeleton structure comprising an interlocking, open three-dimensional mesh of elongated crystals of unneutralized carboxylic acids, neutralized carboxylic acids, or a mixture thereof; the carboxylic acids being selected from the group consisting of monocarboxylic acids with alkyl(ene) chains having an average of from about 12 to about 24 carbon atoms, dicarboxylic acids with alkyl(ene) chains having an average of from about 12 to about 18 carbon atoms, and mixtures thereof;

wherein the composition comprises:

(a) from about 7% to about 25% by weight crystalline phase skeleton structure (2); the neutralized carboxylic acids being at least about 50% sodium carboxylic acids, and from about 1% to about 10% potassium carboxylic acids;

(b) from about 25% to about 94% by weight water; and (c) from about 2% to 35% by weight synthetic surfactant, the synthetic surfactant being selected from the group consisting of amine oxides, polyhydroxy fatty acid amides, ethoxylated alkyl sulfates, alkyl ethoxylates, alkyl sulfates, alkyl benzene sulfonates, alkyl ether carboxylates, alkyl glycosides, methyl glucose esters, betaines, and mixtures thereof;

the composition not containing polyol; the composition being a shaped semi-solid, having a penetration of from 1 mm to about 10 mm, the penetration being measured at 25° C., using a 235 gram Standard Weighted Penetrometer Probe having a 1.27 cm diameter ball attached to a shaft with 200 grams on top of the shaft.

8. The composition of claim 7 wherein the composition comprises from about 25% to about 60% water, and from about 4% to 35% synthetic surfactant selected from the group consisting of amine oxides, polyhydroxy fatty acid amides, ethoxylated alkyl sulfates, alkyl ethoxylates, and mixtures thereof; the crystalline phase skeleton structure (2) comprises neutralized monocarboxylic acids or a mixture of unneutralized monocarboxylic acids and neutralized monocarboxylic acids; the composition comprises a ratio of unneutralized monocarboxylic acids to neutralized monocarboxylic acids of from about 1:1 to about 0:1; and the composition has a ratio of water to neutralized monocarboxylic acids of from about 0.3:1 to about 16:1.

9. The composition of claim 8 wherein the composition comprises:

(a) a maximum of about 15% neutralized monocarboxylic acids, at least about 85% of the alkyl(ene) chains of the monocarboxylic acids being saturated, the alkyl(ene) chains having an average of from about 14 to about 18 carbon atoms, and the ratio of unneutralized monocarboxylic acids to neutralized monocarboxylic acids being from about 1:3 to about 0:1;

(b) from about 30% to about 60% water, the ratio of water to neutralized carboxylic acids being from about 1:1 to about 7.5:1; and (c) from about 8% to about 30% synthetic surfactant.

10. The composition of claim 1, 4, or 9 wherein the cation of the neutralized carboxylic acids is at least about 50% sodium, no more than about 10% potassium, no more than about 35% magnesium, no more than about 35% calcium, no more than about 15% triethanolammonium, and an amount of lithium equal to no more than about 50% of the amount of said sodium.

11. The composition of claim 1, 4 or 9 wherein the aqueous phase additionally comprises from about 1% to about 50% by weight appearance aides selected from the group consisting of compatible salts and salt hydrates.

12. The composition of claim 1, 4 or 9 wherein the composition has a penetration of from 1 mm to about 7 mm.

13. A shape, semi-solid dishwashing detergent composition comprising two phases:

(1) an aqueous phase which is soft or flowable at 25° C.; and (2) a rigid crystalline phase skeleton structure comprising an interlocking, open three-dimensional mesh of elongated crystals of unneutralized carboxylic acids, neutralized carboxylic acids, or a mixture thereof; the carboxylic acids being selected from the group consisting of monocarboxylic acids with alkyl(ene) chains having an average of from about 12 to about 24 carbon atoms, dicarboxylic acids with alkyl(ene) chains having an average of from about 12 to about 18 carbon atoms, and mixtures thereof;

wherein the composition comprises:

(a) from about 7% to about 15% by weight crystalline phase skeleton structure (2);

(b) from about 25% to about 94% by weight water; and (c) from about 2% to about 60% by weight synthetic surfactant, the synthetic surfactant being selected from the group consisting of amine oxides, polyhydroxy fatty acid amides, ethoxylated alkyl sulfates, alkyl ethoxylates, alkyl sulfates, alkyl benzene sulfonates, alkyl glycosides, methyl glucose esters, betaines, and mixtures thereof;

the composition not containing polyol; the composition being a shaped semi-solid, having a penetration of from 1 mm to about 10 mm, the penetration being measured at 25° C., using a 235 gram Standard Weighted Penetrometer Probe having a 1.27 cm diameter ball attached to a shaft with 200 grams on top of the shaft.

14. The composition of claim 13 wherein the composition comprises from about 25% to about 60% water, and from about 4% to about 60% synthetic surfactant selected from the group consisting of amine oxides, polyhydroxy fatty acid amides, ethoxylated alkyl sulfates, alkyl ethoxylates, and mixtures thereof.

15. The composition of claim 14 wherein the crystalline phase skeleton structure (2) comprises neutralized monocarboxylic acids or a mixture of unneutralized monocarboxylic acids and neutralized monocarboxylic acids; the composition comprises from about 7% to about 15% neutralized monocarboxylic acids; the composition has a ratio of unneutralized monocarboxylic acids to neutralized monocarboxylic acids of from about 1:1 to about 0:1; and the composition has a ratio of water to neutralized monocarboxylic acids of from about 0.3:1 to about 16:1.

16. The composition of claim 15 wherein the composition comprises:

(a) from about 7% to about 15% neutralized monocarboxylic acids, at least about 85% of the alkyl(ene) chains of the monocarboxylic acids being saturated, and the ratio of unneutralized monocarboxylic acids to neutralized monocarboxylic acids being from about 1:3 to about 0:1;

(b) from about 25% to about 60% water, the ratio of water to neutralized monocarboxylic acids being from about 0.7:1 to about 7.5:1; and (c) from about 8% to about 30% synthetic surfactant.

17. The composition of claim 15 wherein the composition comprises:

(a) from about 7% to about 15% neutralized monocarboxylic acids, the ratio of unneutralized monocarboxylic acids to neutralized monocarboxylic acids being from about 1:6 to about 0:1, the average chain length of the unneutralized and neutralized monocarboxylic acids being from about $C_{14}$ to about $C_{18}$, and at least about 95% of the alkyl(ene) chains of the monocarboxylic acids being saturated;

(b) from about 30% to about 45% water, the ratio of water to neutralized monocarboxylic acids being from about 1:1 to about 4.5:1; and (c) from about 8% to about 30% synthetic surfactant.

18. A shaped, semi-solid dishwashing detergent composition comprising two phases:

(1) an aqueous phase which is soft or flowable at 25° C.; and (2) a rigid crystalline phase skeleton structure comprising an interlocking, open three-dimensional mesh of elongated crystals of unneutralized carboxylic acids, neutralized carboxylic acids, or a mixture thereof; the carboxylic acids being selected from the group consisting of monocarboxylic acids with alkyl(ene) chains having an average of from about 12 to about 24 carbon atoms, dicarboxylic acids with alkyl(ene) chains having an average of from about 12 to about 18 carbon atoms, and mixtures thereof;

wherein the composition comprises:

(a) from about 7% to about 25% by weight crystalline phase skeleton structure (2); the neutralized carboxylic acids being at least about 50% sodium carboxylic acids, and from about 1% to about 10% potassium carboxylic acids;

(b) from about 25% to about 94% by weight water; and (c) from about 2% to about 60% by weight synthetic surfactant, the synthetic surfactant being selected from the group consisting of amine oxides, polyhydroxy fatty acid amides, ethoxylated alkyl sulfates, alkyl ethoxylates, alkyl sulfates, alkyl benzene sulfonates, alkyl glycosides, methyl glucose esters, betaines, and mixtures thereof;

the composition not containing polyol; the composition being a shaped semi-solid, having a penetration of from 1 mm to about 10 mm, the penetration being measured at 25° C., using a 235 gram Standard Weighted Penetrometer Probe having a 1.27 cm diameter ball attached to a shaft with 200 grams on top of the shaft.

19. The composition of claim 13 or 18 wherein the composition has a penetration of from 1 mm to about 7 mm.

* * * * *